United States Patent [19]

Sidor et al.

[11] 4,194,547

[45] Mar. 25, 1980

[54] GOLF CLUB HOLDER

[76] Inventors: Edward J. Sidor, 1482 3 Mile Rd. NE.; William E. Sidor, 1816 4 Mile NE., both of Grand Rapids, Mich. 49505

[21] Appl. No.: 934,395

[22] Filed: Aug. 17, 1978

[51] Int. Cl.[2] ..... A63B 55/00

[52] U.S. Cl. ..... 150/1.5 R; 24/257; 279/102

[58] Field of Search ..... 150/1.5 R, 1.5 B, 1.5 C; 24/257 R, 256; 211/60 G; 248/314; 279/23 R, 102; 264/296, 322; 403/361

[56] References Cited

U.S. PATENT DOCUMENTS

| | | | |
|---|---|---|---|
| 1,756,902 | 4/1930 | Boyce | 150/1.5 R |
| 1,849,610 | 3/1932 | Boyce | 150/1.5 R |
| 2,436,687 | 2/1948 | Corbett | 150/1.5 R |
| 2,653,181 | 9/1953 | Millett | 24/257 R X |
| 2,857,168 | 10/1958 | Neaverson | 150/1.5 B X |
| 2,970,629 | 2/1961 | Masten | 150/1.5 R |
| 3,324,226 | 6/1967 | Tems | 248/314 X |
| 3,460,597 | 8/1969 | Daly | 150/1.5 R |
| 3,503,518 | 3/1970 | Black | 150/1.5 R X |
| 3,883,150 | 5/1975 | Varela | 150/1.5 R X |
| 4,055,207 | 10/1977 | Goodwin | 150/1.5 R |

*Primary Examiner*—Donald F. Norton

*Attorney, Agent, or Firm*—Price, Heneveld, Huizenga & Cooper

[57] ABSTRACT

A golf club holder is disclosed comprising an elongate tube of a resilient material having a first end open and adapted for receiving a golf club handle and shaft and a second end including a spring clip means formed from the tube for resiliently gripping a golf club handle and detachably retaining same within the tube. Preferably, the spring clip means comprises a portion of the tube adjacent the second end with a gradually reduced cross-sectional area created by one or more longitudinally extending folds in the tube. The spring clip means develops sufficient gripping force such that when a plurality of the elongate tubes are arranged in a parallel array, and secured in a golf bag, the clubs inserted in the tubes will not fall from the bag even when the bag is held upside down. Additionally, a rack is disposed above the tubes to prevent the heads of the clubs from interfering.

32 Claims, 10 Drawing Figures

GOLF CLUB HOLDER

BACKGROUND OF THE INVENTION

This invention relates generally to golf club bags and golf club bag inserts for facilitating the orderly arrangement of golf clubs. In particular, the invention is directed to a golf club separating tube including means for resiliently retaining a golf club handle within the tube.

Golf bags come in a variety of shapes and sizes and are additionally manufactured with a variety of special features which enhance their usefulness on the golf course. For example, many golf club bags have sophisticated designs for ensuring the orderly arrangement and separation of the golf clubs within the open end of the golf bag. To a golfer, nothing is more disconcerting then attempting to pick out a particular club from a group of entangled clubs in the bag. Furthermore, when the clubs are allowed to bunch together, and are subjected to the inevitable vibration and jarring involved in transporting the clubs in the back of a car or in a golf cart, the clubs will repeatedly rub together and become marred.

In an attempt to alleviate this problem, golf club manufacturers have taken two basic approaches. In very expensive bags, the manufacturers provide, as an integral portion thereof, an apertured closure device disposed at the normally open end of the bag so that the golf clubs may be inserted in the apertures and retained in an orderly fashion. The second approach used on less expensive bags, where it is economically unjustifiable to provide an integrally molded apertured member, the manufacturer will provide a plurality of ribs extending transversely across the normally open end of the bag, the ribs tending to divide the open end of the bag into two or three compartments by which the golfer may classify his clubs, as for example by woods in one section, and irons in another. These ribs are better than no compartments at all, but of course do not adequately segregate the individual clubs from one another.

Unfortunately, these two approaches only provide a solution to the golfer who owns an inexpensive golf bag and who has reached the decision that a new golf bag is necessary for his full enjoyment of the game. Thus, a class of golf bag inserts has developed, providing inexpensive solutions to the problem of golf club placement in a conventional golf club bag through the provision of insertable elements including golf club receiving tubes and racks. Golf club tubes are elongate tubular plastic members which are used to fill a conventional golf club bag and create a series of compartments for insertion and separation of the golf club handles and shafts. Sometimes these tubes are used in conjunction with tube sheets for further separating the golf club handles and shafts and racks for receiving, and orderly separating the heads of clubs. Although these arangements solve the problems of keeping the golfer's clubs separated under normal conditions, these golf club inserts and the two previously discussed types of golf bags, including built-in golf club separators, cannot solve the problem of retaining the golf clubs and preventing their damage in the case of a golf bag spillover.

As opposed to golf bags, the prior art also reveals a class of golf club holders comprising a plurality of elongate tubes having one end open and adapted for receiving a golf club handle and shaft. Often these holders are included in an assembly wherein a plurality of such holders are secured in a generally parallel array but one or more tube sheets. Often the assembly is provided with wheels and/or handles for facilitating transport. Examples of these types of golf club holders are found in the prior art that include metal spring clips disposed at the bottom of the tubes for securing the golf club handles within the tubes. Although these metal spring clips solve the spillover problem, prior art golf club holders of this type do not include racks for ensuring that the heads of the clubs do not interfere. Furthermore, the addition of a metallic clip to the bottom of an elongate golf club receiving tube of the type usually only having one open end is time consuming, and expensive.

SUMMARY OF THE INVENTION

These and other problems in the prior art are solved by the golf club holder of the present invention which in its most elemental form comprises an elongate tube of a resilient material, first and second ends oppositely and longitudinally disposed on the tube, the first end being open and adapted for receiving a golf club handle and shaft and a spring clip means adjacent the second end. The spring clip means is formed directly from the tube and serves to resiliently grip a golf club handle and detachably retain the same within the tube even when the tube is upside down.

In more narrow aspects of the invention, the spring clip means comprises a portion of the tube disposed adjacent the second end of the tube having a gradually reduced cross-sectional area with the smallest cross section of that portion of the tube being approximately disposed at the second end of the tube. Preferably, the second end of the tube is open to increase resiliency of the spring clip means and the portion of the tube of reduced cross-sectional area is created by provision of a longitudinally extending fold of gradually increasing depth.

The invention encompasses a method of manufacturing a golf club holder comprising the steps of first, providing an elongate tube of a resilient thermoplastic material having a first open end for inserting the handle and shaft of a golf club, and second, forming a spring clip in the tube for resiliently gripping a golf club handle by heating an elongate longitudinally extending localized area on the tube and applying a compressive force to the tube to form a longitudinally extending fold.

A golf club holder assembly is provided by securing a plurality of the tubes in a generally parallel array with first and second tube sheets. A rack is disposed above the first ends of the tubes for completely isolating the heads of the golf clubs retained in the tubes. The golf club holder assembly may be inserted in an existing golf club bag of the type having simple dividers at the top of the bag or having no arrangement at all for maintaining an orderly arrangement of clubs in the bag. However, the assembly may also be built into a bag during the construction of the bag.

DESCRIPTION OF THE PREFERRED EMBODIMENTS

Figures 1, 6:
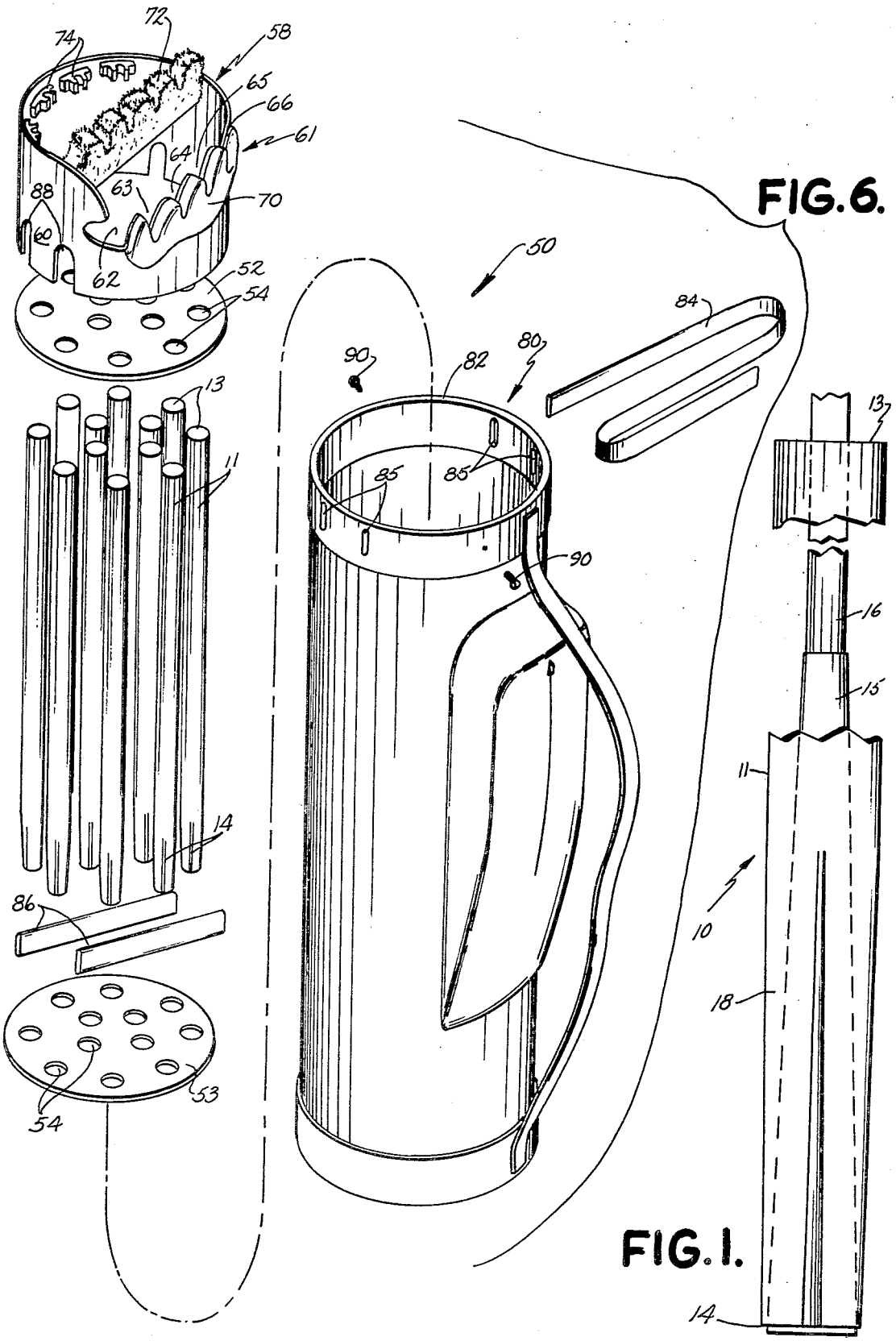
FIG. 1 is a partial elevational view of a golf club holder constructed according to the present invention.
FIG. 6 is an exploded assembly of a golf club holder constructed according to the present invention.

Referring now to FIG. 1, a golf club holder 10 is illustrated comprising an elongate tube 11 of a resilient material. The tube 11 includes first and second ends 13 and 14, respectively, oppositely and longitudinally disposed on the tube 11. The first end 13 is open for receiving a golf club handle 15 and shaft 16. Spring clip means 18 is formed from the tube 11 for resiliently gripping a golf club handle and detachably retaining the same within the tube. The spring clip means is disposed adjacent the second end 14 of the tube 11. Broadly speaking, the spring clip means 14 comprises a portion of the tube 11 having a reduced cross-sectional area such that the walls of the tube 11 snugly grip the handle 15 of the golf club shaft.

Figure 2:
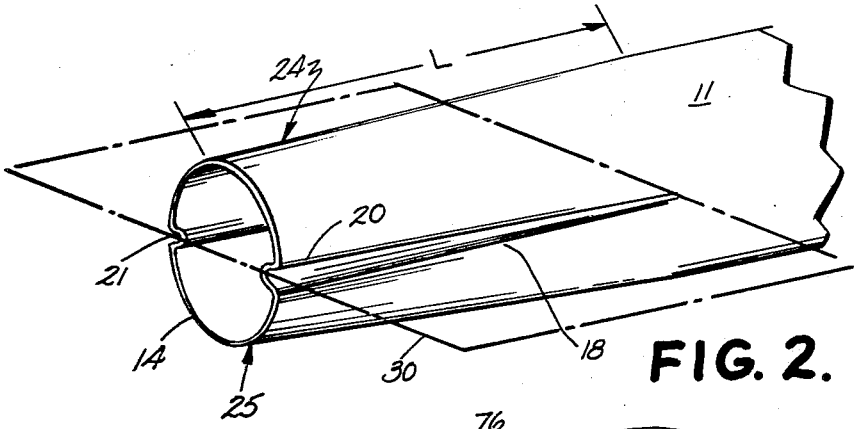
FIG. 2 is a perspective view of a portion of the golf club holder of FIG. 1, including a resilient clip means formed from the walls of the golf club holder.

Referring now to FIG. 2, it is illustrated that preferably the second end 14 of the tube 11 is open to increase the resiliency of the spring clip means 18. The spring clip means 18 comprises a portion or length of tube L adjacent the second end 14 which is provided with a gradually reduced cross-sectional area. The smallest cross section of the portion L of the tube 11 is disposed approximately at the second end 14. The portion L of the tube 11 is provided with a gradually reducing cross-sectional area by provision of at least one longitudinally extending fold 20. The longitudinally extending fold 20 gradually reduces the cross-sectional area of the portion L of the tube 11, since the fold 20 is provided with a gradually increasing depth, the deepest portion of the fold 20 being disposed approximately at the second end 14 of the tube 11. Tubes of generally circular cross section are preferred since the walls of the tube more closely conform to the outer surface of the golf club handle to be inserted therein. The spring clip means 18 is formed of a portion of the tube 11 of gradually reducing cross-sectional area such that the handle to be received therein is gradually wedged into the tube 11, expanding the same with very little force, yet snugly holding the golf club handle in place once the handle is properly positioned in the tube.

Figure 3:
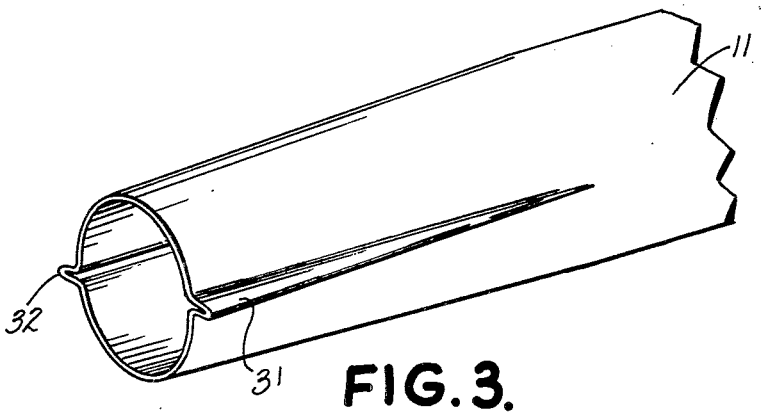
FIG. 3 is a perspective view illustrating another embodiment of a spring clip means constructed according to the present invention.

As FIG. 2 illustrates, the portion L of the tube 11, having a gradually reduced cross-sectional area may include a plurality of folds such as the one illustrated at 20. Although only one fold is necessary to effect a gradual reduction in the cross-sectional area of the tube 11, a pair of folds 20 and 21 are generally provided. Preferably, the pair of folds 20 and 21 are disposed in a longitudinally extending plane 30 which bisects tube 11, the pair of folds 20 and 21 being disposed on opposite sides of the tube 11. In cases where the tube 11 is comprised of a thermoplastic, as well as resilient material, the pair of folds 20 and 21 may be formed by local heating of a longitudinal area on the side of the tube and the application of compressive force at 24 and 25. In the embodiment of FIG. 2, the pair of folds 20 and 21 both extend into the plane 30 in a direction which may be generally described as radial. In FIG. 2, both of the folds 20 and 21 extend radially inwardly of the tube 11. However, as illustrated in FIG. 3, one or more folds such as the folds illustrated at 31 and 32 may be provided, extending radially outward of the tube 11. In other embodiments of the invention not here illustrated, one or more folds directed inwardly and outwardly, such as the folds 20 and 21, and 31 and 32, respectively, may be provided.

Figure 4:
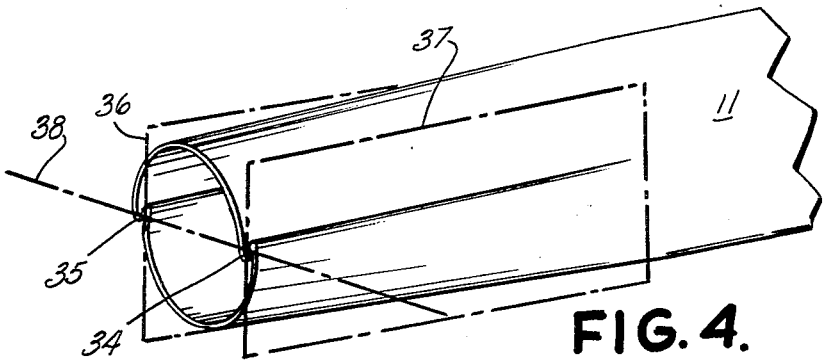
FIG. 4 is a perspective view illustrating another embodiment of a spring clip means constructed according to the present invention.
Figure 5:
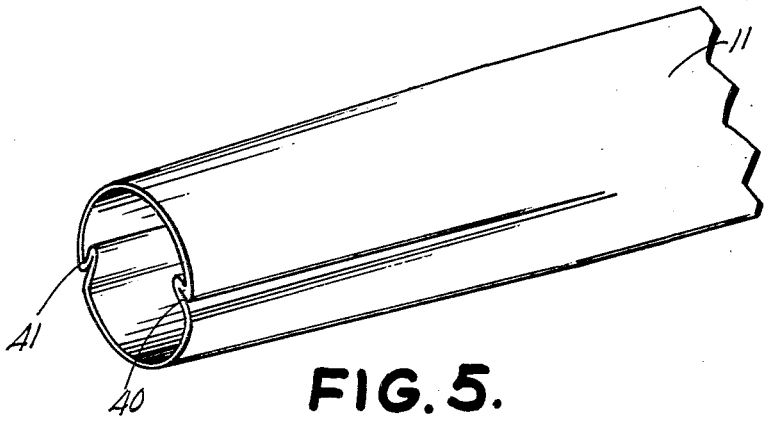
FIG. 5 is another embodiment illustrating a spring clip means constructed according to the present invention.

Referring now to FIG. 4, it is illustrated that one or more folds, such as those illustrated at 34 and 35 on tube 11, may be provided which extend into a pair of planes 36 and 37 which are roughly perpendicular to the longitudinal plane 30 represented in FIG. 4 by line 38. It may also be said that the folds 34 and 35 are roughly aligned with tangents of the circular tube 11. However, as further illustrated by FIG. 5, the tube 11 may be provided with a combination of folds 40 and 41 which extend into planes bisecting the tube and planes perpendicular thereto, respectively. In such cases the fold 40, which extends into the plane bisecting the tube 11, may extend either inward or outward of the tube 11.

The invention includes a method of manufacturing a resilient golf club holder, such as the holder 11 illustrated in FIG. 1, for detachably mounting a golf club whose handle and shaft are illustrated at 15 and 16, respectively. According to the method, first an elongate tube 11 of a resilient thermoplastic material is provided. The tube 11 is provided with a first open end 13 for inserting a handle and shaft of a golf club. Second, a spring clip 18 is formed from the walls of the tube adjacent the second end 14 of the tube 11. The spring clip 18 resiliently grips the golf club handle 15 and attachably retains the same within the tube 11. Referring again to FIG. 2, the step of forming the spring clip 18 involves molding or forming a portion L of the tube 11 with a reduced diameter. The portion L of the tube 11 of reduced diameter is adjacent the second end 14 and preferably presents a gradually decreasing cross-sectional area, the smallest cross section being disposed approximately at the second end 14 of the tube 11.

More specifically, the forming step involves heating a localized area of the tube and applying force to the tube in a manner which effects a reduction in the cross-sectional area of the tube in that localized area. Preferably, the heating step involves heating a longitudinally extending localized area which, for example, generally corresponds to the area of the fold 20 in FIG. 2. In the step of applying force, a compressive force is applied to the tube, for example at 24 and 25, to create a longitudinally extending fold in the tube such as the one illustrated at 20. Upon cooling of the thermoplastic tube 11, a permanent and resilient accordian like fold 20 remains. It should be understood that only one fold, such as the one illustrated at 20 is necessary to effect the reduction in diameter desired over the portion L of the tube 11. However, generally pairs of folds are provided, such as the opposing pairs 20 and 21, the pairs of folds being preferred in order to provide increased resiliency for the spring clip means.

The spring clip means formed in such a manner is fully capable of holding a heavy golf club, such as a wood, under conditions that present minor shock loading or vibration, even when the tube is carried upside down. Furthermore, the tube or golf club holder of the present invention presents a considerable cost saving over prior art tubes including resilient spring clip means since the necessity of adding a separate metallic spring clip means to the end of the golf club receiving tube is eliminated. In fact, the golf club tubes employed to construct the golf club holder of the present invention are standard articles of commerce made of an extruded resilient thermoplastic material. A suitable tube, commercially available for use with the present invention, is marketed by the Kent Company of Ashland, Ohio.

Figure 8:
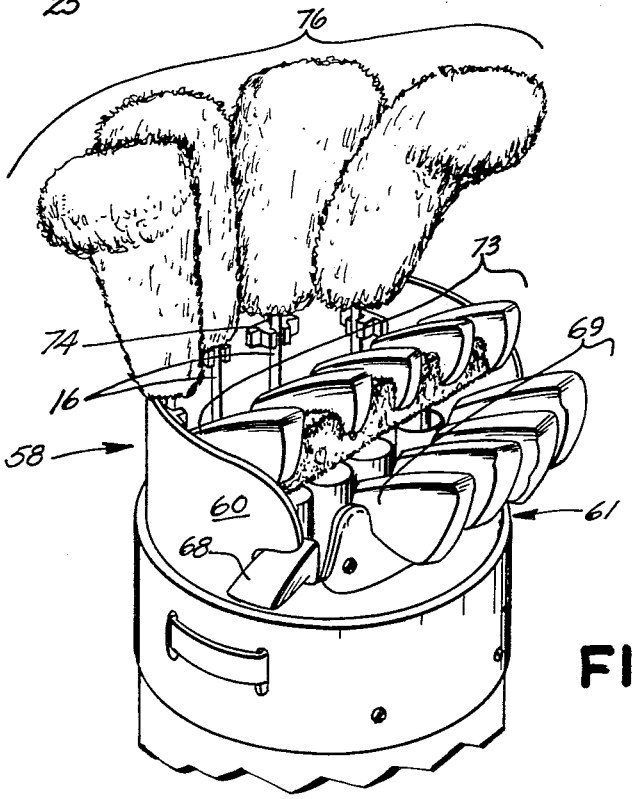
FIG. 8 is a perspective view of a rack employed in one embodiment of the invention showing the manner in which the golf clubs are retained therein.
Figure 7:
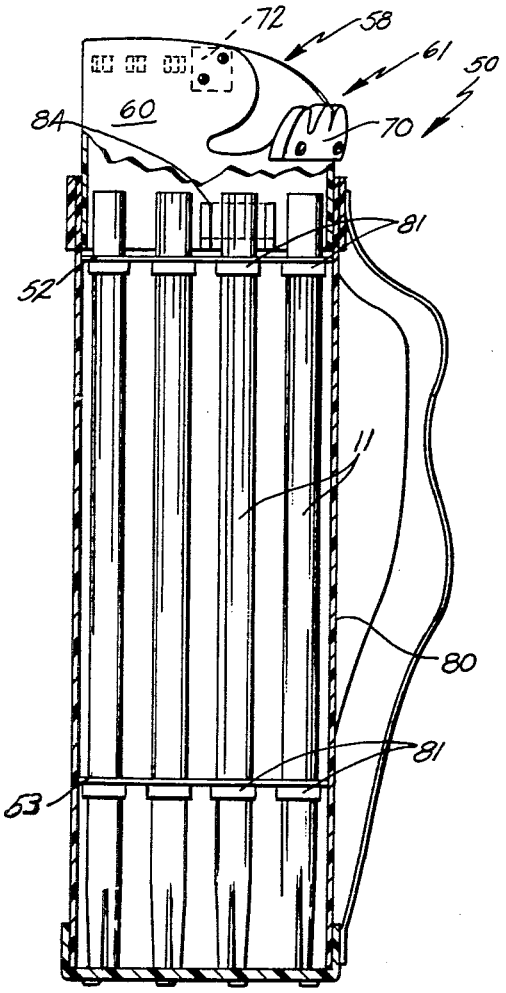
FIG. 7 is an elevational view, partially in section, of a golf club holder constructed according to the present invention.

Referring now to FIGS. 6 and 7, a golf club holder assembly 50 constructed according to the present invention is illustrated. According to the invention, a plurality of elongate tubes 11, of a resilient material, are secured in a parallel array by first and second tube sheets 52 and 53, respectively. The tube sheets 52 and 53 are generally planar members, including an array of apertures 54, corresponding to the desired pattern of the array of tubes 11. The tubes 11 are then inserted into tube sheets 52 and 53 suitably secured thereto by interference fit, an adhesive tape or the like. Each of the tubes 11 include first and second ends 13 and 14. The first ends 13 of the tubes 11 are open and adapted for receiving a golf club handle and shaft. The second ends 14 of the tubes 11 include spring clip means as previously described for resiliently gripping a golf club handle and detachably retaining the same within of the tubes. A rack 58 is disposed above the first end 13 of the tubes 11. As best illustrated in FIG. 8, the rack 58 serves to separate the heads of the golf clubs retained in the tubes 11 thereby completely isolating each club within the assembly. This combination successfully isolates each of the clubs during normal use and transportation of the assembly and even prevents the clubs from coming in contact with each other during a spillover, since the handles of the clubs are securely retained in the tubes 11, wedging the heads of the clubs in the rack 58.

Figure 10:
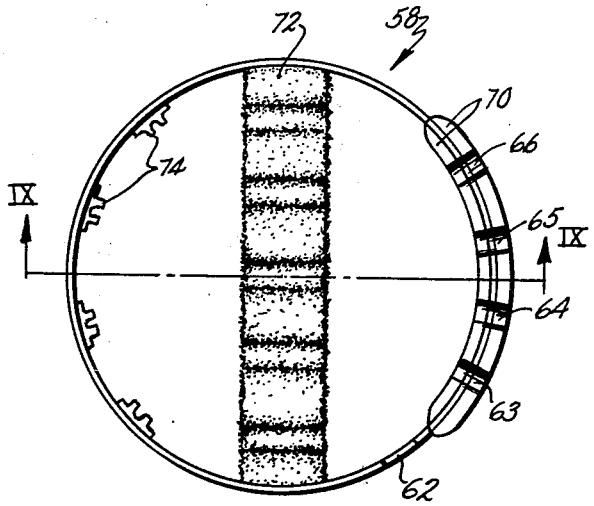
FIG. 10 is a top view of the rack of FIG. 9.
Figure 9:
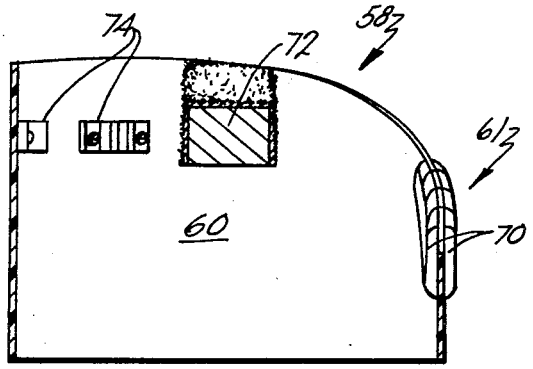
FIG. 9 is an elevational view, partially in section, of the rack comprising part of the golf club holder of the present invention.

Referring now to FIGS. 9 and 10, as well as 6 and 8, the rack 58 is further illustrated. The rack 58 may comprise any one of a variety of combinations of curvilinear, straight, and compartmentalized type racks and/or a plurality of resilient elastomer clips which grip the golf club shaft. In the preferred embodiment, the rack 58 comprises a generally cylindrical body 60, including a curvilinear rack 61. The curvilinear rack 61 is formed by cutouts 62 through 66. The cutout 62 is suitably shaped for holding a putter 68, best illustrated in FIG. 8. The cutouts 63 through 66 hold the irons generally indicated by the numeral 69. A suitable material for the cylindrical body 60 of the rack 58 is high density polyethylene with a thickness of approximately 0.09 inches. The curvilinear rack 61 formed from cutouts in the body 60 is preferably lined on both sides of the wall of the body 60 with suitable sheets of elastomer at 70. The sheets of elastomer 70 may be riveted, glued or otherwise suitably secured to the body 60 of the rack 58. A suitable elastomer for use in the construction of the curvilinear rack 61 is a rubber made by the B. F. Goodrich Company identified as SVR 60 Sheet, and sometimes called die rubber.

The rack 58 further includes a linear rack 72, generally bisecting the cylindrical body 60. The rack 72 is made of wood, plastic or other suitable material covered with felt, cloth, or rubber and is secured to opposing sides of the cylindrical body 60 with screws or the like. The rack 72 serves to separate an array of irons generally indicated by the numeral 73 in FIG. 8. The rack 58 further includes a plurality of elastomer clips 74 glued, riveted or otherwise suitably secured to the cylindrical body 60. As best illustrated in FIG. 8, the elastomer clips 74 serve to partially encircle and retain the shafts 16 of a plurality of woods generally indicated by the numeral 76. The array of tubes 11 is positioned by tube sheets 52 and 53 such that one tube is disposed immediately below each golf club head receiving area of the rack 58.

Referring now specifically to FIGS. 6 and 7, it is illustrated that the assembly 50 is particularly adapted for insertion in a conventional golf club bag 80. According to the invention, the tubes 11 are inserted in tube sheets 52 and 53 and secured thereto. In this case, as best illustrated in FIG. 7, a layer of adhesive tape is wound about the tubes at 81 to prevent them from being drawn upward through tube sheets 52 and 53. The bundle of tubes retained by the tube sheets are then inserted in the open end 82 of the bag 80 and secured thereto by suitable means such as the strap 84. The strap 84 is wound through apertures 85 in bag 80, across the top of first tube sheet 52 to securely retain the tube sheets and tube bundle within the bag 80. In embodiments of the invention employing a bag 80, having dividers such as those illustrated at 86 in FIG. 6, normally these dividers are retained in the open end 82 of the bag 80 by threading the strap 84 therethrough. In such a case, the dividers 86 will be placed atop first tube sheet 52 and the strap 84 will be threaded therethrough to secure the tube bundle and tube sheets within the bag 80. The rack 58 is then inserted in the open end 82 of the bag 80. The cylindrical body 60 includes cutouts at 88 to allow the cylindrical body 60 to fit over dividers 86 and strap 84. The cylindrical rack 58 is then suitably secured to the open end 82 of the bag 80 with glue or screws such as those illustrated at 90.

Although the embodiment of the assembly herein disclosed is particularly adapted for insertion in a conventional golf bag of the type having no provision for separating the clubs within the bag, or simply having one or more dividers in the open end of the bag, it is to be understood that the golf club holder or assembly of the present invention may be built into a golf bag during its construction.

The above description should be considered as exemplary and that of the preferred embodiment only. The true spirit and scope of the present invention should be determined by reference to the appended claims. It is desired to include within the appended claims all such modifications of the invention that come within the proper scope of the claims.

The embodiments of the invention in which an exclusive property or privilege is claimed are defined as follows.

1. A golf club holder comprising:

an elongate tube of a resilient material;

first and second ends oppositely and longitudinally disposed on said tube;

said first end of said tube being open and adapted for receiving of a golf club handle and shaft;

spring clip means formed from said tube for resiliently gripping a golf club handle and detachably retaining the same within said tube;

said spring clip means comprising at least one longitudinally extending fold disposed in said tube for gradually reducing the cross-sectional area of said tube; and said spring clip means being disposed adjacent said second end of said tube.

2. The golf club holder of claim 1 wherein said tube is circular in cross section.

3. The golf club holder of claim 1 wherein said second end is open to increase the resiliency of said spring clip means.

4. The golf club holder of claim 1 wherein the smallest cross section said tube is disposed approximately at said second end by providing said fold with a gradually increasing depth, the deepest portion of said fold being disposed at said second end.

5. The golf club holder of claim 4 wherein said second end of said tube is open to increase the resiliency of said second end.

6. The golf club holder of claim 5 wherein said tube is roughly circular in cross section.

7. The golf club holder of claim 6 wherein said fold extends in a plane roughly parallel to a tangent of said tube of circular cross section.

8. The golf club holder of claim 6 wherein said fold extends in a plane roughly orthogonal to a tangent of said tube of circular cross section.

9. The golf club holder of claim 8 wherein said fold extends inwardly on said tube.

10. The golf club holder of claim 8 wherein said fold extends outwardly on said tube.

11. The golf club holder of claim 6 wherein a pair of said folds is provided.

12. The golf club holder of claim 11 wherein said pair of folds are roughly disposed on a longitudinal plane bisecting said tube, on opposite sides of said tube.

13. The golf club holder of claim 12 wherein said pair of folds extend roughly into said longitudinal plane.

14. The golf club holder of claim 12 wherein said pair of folds extend into a pair of planes roughly perpendicular to said longitudinal plane.

15. The golf club holder of claim 12 wherein said pair of folds comprise:

a first fold extending into said longitudinal plane; and a second fold extending into a plane roughly perpendicular to said longitudinal plane.

16. The golf club holder of claim 12 wherein said pair of folds extend into said longitudinal plane outward of said tube.

17. The golf club holder of claim 16 wherein said pair of folds comprise:

a first fold extending into said tube; and a second fold extending out of said tube.

18. The golf club holder of claim 1 wherein said tube is made of a thermoplastic material, said fold being formed by local heating of a longitudinal area of said tube and applying a compressive force on said tube.

19. The golf club holder of claim 1 wherein said tube is provided with a plurality of said longitudinally extending folds radially spaced about said portion of said tube adjacent said second end of said tube.

20. A golf club holder comprising:

an elongate tube of a resilient material;

said tube having a roughly circular cross section;

first and second ends oppositely and longitudinally disposed on said tube;

said first end of said tube being open and adapted for insertion of a golf club handle and shaft;

a pair of longitudinally extending folds disposed adjacent said second end and extending along a portion of said tube;

said pair of longitudinally extending folds having a generally increasing depth, the deepest portion of said folds being disposed on said second end;

said pair of longitudinally extending folds thereby gradually decreasing the cross-sectional area of said tube for resiliently gripping a golf club handle and detachably retaining the same within said tube;

said second end being open to increase the resiliency of said tube; and said pair of longitudinally extending folds being roughly disposed in a longitudinal plane bisecting said tube, on opposite sides of said tube.

21. A golf club holder assembly comprising in combination:

a plurality of elongate tubes of a resilient material;

first and second ends oppositely and longitudinally disposed on each of said tubes;

said first ends of said tubes being open and adapted for receiving a golf club handle and shaft;

spring clip means disposed in each of said tubes and formed from each of said tubes for resiliently gripping a golf club handle and detachably retaining the same within each of said tubes;

said spring clip means comprising at least one longitudinally extending fold disposed in each said tube for gradually reducing the cross-sectional area of said tube;

first and second tube sheets for retaining said tubes in parallel array; and a rack disposed above said first ends of said tubes for separating a plurality of golf clubs retained in said tubes, whereby each of the clubs is completely isolated and retained within the assembly even when the assembly is held upside down.

22. The golf club holder assembly of claim 21 wherein said assembly is inserted in a golf bag and retained therein, said rack being disposed at the opening of said bag.

23. The golf club holder assembly of claim 22 wherein said assembly is built into said bag during the construction of said bag.

24. The golf club holder assembly of claim 22 wherein said assembly is retained in said bag by a strap connected to said bag and extending across one of said tube sheets.

25. The golf club holder assembly of claim 22 wherein said rack is secured to the top of said golf bag.

26. The golf club holder assembly of claim 21 wherein said rack includes a plurality of elastomeric clips for encircling the golf club shafts.

27. The golf club holder assembly of claim 21 wherein said rack is generally cylindrical in shape including a curvilinear rack section formed with golf club head receiving cut outs in said cylindrical rack.

28. The golf club holder assembly of claim 27 wherein said cylindrical rack includes a linear rack section bisecting said cylindrical rack.

29. The golf club holder assembly of claim 21 wherein said spring clip means comprises a portion of said tubes having a reduced cross-sectional area.

30. The golf club holder assembly of claim 21 wherein said second ends of said tubes are open to increase the resiliency of said spring clip means.

31. The golf club holder of claim 21 wherein the smallest cross section of each of said tubes is disposed approximately at said second ends of said tubes by providing each of said folds with a gradually increasing depth, the deepest portion of said folds being disposed at said second ends of said tubes.

32. The golf club holder assembly of claim 31, wherein a pair of said folds is provided on each of said tubes, said pairs of folds being disposed approximately in longitudinal planes bisecting said tubes.

* * * * *

UNITED STATES PATENT AND TRADEMARK OFFICE

CERTIFICATE OF CORRECTION

PATENT NO. : 4,194,547

DATED : Mar. 25, 1980

INVENTOR(S) : Edward J. Sidor et al

It is certified that error appears in the above-identified patent and that said Letters Patent are hereby corrected as shown below:

Column 1, line 68:

"but" should be --by--

Column 5, line 27:

After "53" insert --and--

Column 5, line 34:

After "within" insert --each--

Column 6, line 49:

Delete "or" after holder

Column 7, line 16:

Insert --of-- after "section"

Column 8, line 9:

"generally" should be --gradually--

Signed and Sealed this

*Twenty-second* Day of *July 1980*

[SEAL]

*Attest:*

SIDNEY A. DIAMOND

*Attesting Officer*

*Commissioner of Patents and Trademarks*